United States Patent [19]

Hundertmark

[11] 4,391,592

[45] Jul. 5, 1983

[54] HYDRAULIC TRIM-TILT SYSTEM

[75] Inventor: James M. Hundertmark, Fond du Lac, Wis.

[73] Assignee: Brunswick Corporation, Skokie, Ill.

[21] Appl. No.: 191,733

[22] Filed: Sep. 29, 1980

[51] Int. Cl.[3] ..... F15B 15/22

[52] U.S. Cl. ..... 440/61; 440/53; 91/401

[58] Field of Search ..... 440/63, 52, 56, 53, 440/61; 91/401

[56] References Cited

U.S. PATENT DOCUMENTS 2,630,830 3/1953 Meddock ..... 91/401

3,581,702 6/1971 Moberg ..... 440/61

4,308,018 12/1981 Nakamura et al. ..... 91/401

*Primary Examiner*—Trygve M. Blix

*Assistant Examiner*—D. W. Keen

*Attorney, Agent, or Firm*—O. T. Sessions

[57] ABSTRACT

A hydraulic trim-tilt system 15 for an outboard motor 10 includes a hydraulic trim-tilt piston-cylinder unit 16 pivotally connected to both the transom bracket 11 and the swivel bracket 12. Hydraulic trim piston-cylinder units 22 are mounted in the transom bracket 11. A pilot operated check valve 43 mounted in the piston 38 of one of the trim piston-cylinder units 22 serves to limit the maximum pressure in the system when the trim piston-cylinder units 22 have reached the end of their stroke.

7 Claims, 6 Drawing Figures

HYDRAULIC TRIM-TILT SYSTEM

DESCRIPTION

1. Hydraulic Trim-Tilt System

This invention relates to outboard propulsion units for water craft and particularly to hydraulic devices for trimming and tilting outboard propulsion units.

2. Background Art

U.S. Pat. Nos. 3,581,702, 3,722,455, and 3,885,517 all describe hydraulic trim-tilt systems utilizing separate trim and tilt hydraulic cylinders driven by a single pump to trim and tilt an outboard propulsion unit about its tilt axis. In these systems both the trim and the tilt cylinders are pressurized with hydraulic fluid from the single pump in both the trim and the tilt mode of operation. In the trim mode both the trim and tilt cylinders are active to trim the propulsion unit, while in the tilt mode the trim cylinders have reached the end of their stroke leaving only the tilt cylinders to tilt the engine. The systems are provided with pressure relief valves to permit the tilt cylinders to act as shock absorbers. These systems have relied on system geometry, i.e., the relative lengths of the moment arms on which the trim and tilt cylinders act and the relative diameters of the cylinders, to prevent tilting the propulsion unit beyond the trim range when the propulsion unit is producing substantial thrust loads. This arrangement limits the diameter of the tilt cylinders, thus restricting their effectivenes as shock absorbers. Further, with such systems the geometry of the system must be carefully matched to the propulsion unit with which it is employed.

DISCLOSURE OF INVENTION

A hydraulic system for trimming and tilting an outboard propulsion unit such as found on outboard motor or stern drive units which are pivotally mounted on a boat has at least a first and second extensible hydraulic piston-cylinder unit. A hydraulic pump supplies hydraulic fluid to the piston-cylinder units and a pressure relief device limits the maximum pressure supplied to the first piston-cylinder unit when the second piston-cylinder unit has extended a predetermined amount.

The pressure relief device may be a pilot operated check valve mounted in a bore through a piston of the second hydraulic motor. In a particularly compact arrangement, the pressure relief device may have a pilot operated valve at one end of the bore with a valve stem projecting from one end of the bore to engage the end of the hydraulic cylinder at one of the piston stroke. At the other end of the bore a ball check valve may be used with a single spring between the ball valve and the pilot valve to bias them both towards a closed position.

The invention is particularly useful to prevent tilting of the unit beyond its maximum trim position when the propulsion unit is producing a significant amount of thrust. The hydraulic trim-limit system is compact, inexpensive and does not require external hardware. Furthermore, a single system can be adopted for use with different size engines by merely changing the spring rate of the relief valve spring.

BEST MODE FOR CARRYING OUT THE INVENTION

Figure 1:
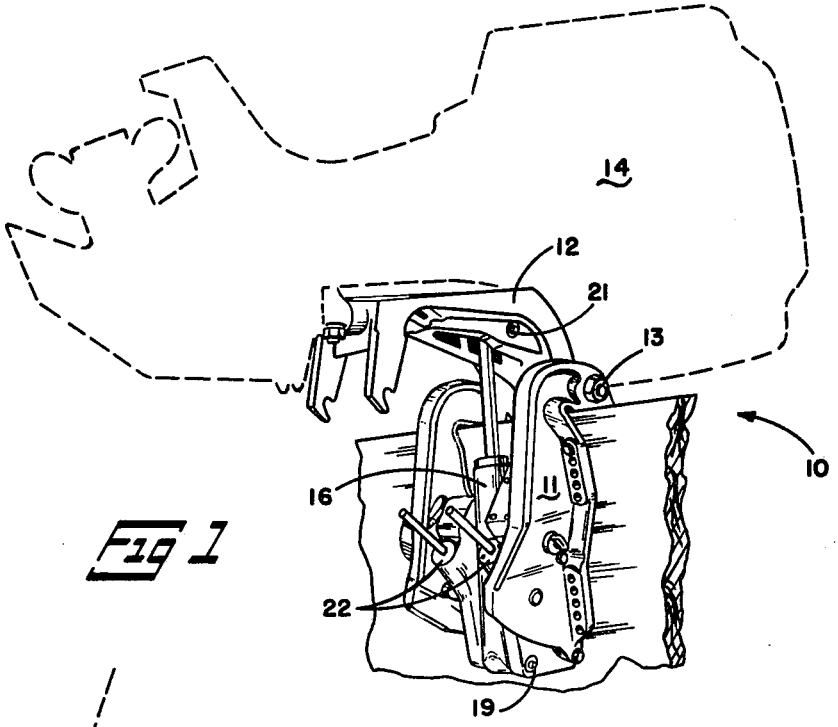
FIG. 1 is a perspective view showing an outboard motor incorporating features of the invention, with the outboard motor in its full tilt position.

The outboard motor 10 shown in the figures includes a transom bracket 11 for attachment to the transom of a boat. A swivel bracket 12 is mounted on the transom bracket 11 by a tilt pin 13 for tilting movement, and the outboard drive unit 14, shown in phantom in FIG. 1, is pivotally mounted in a conventional manner on the swivel bracket to provide steering control about a generally vertical steering axis.

Figure 2:
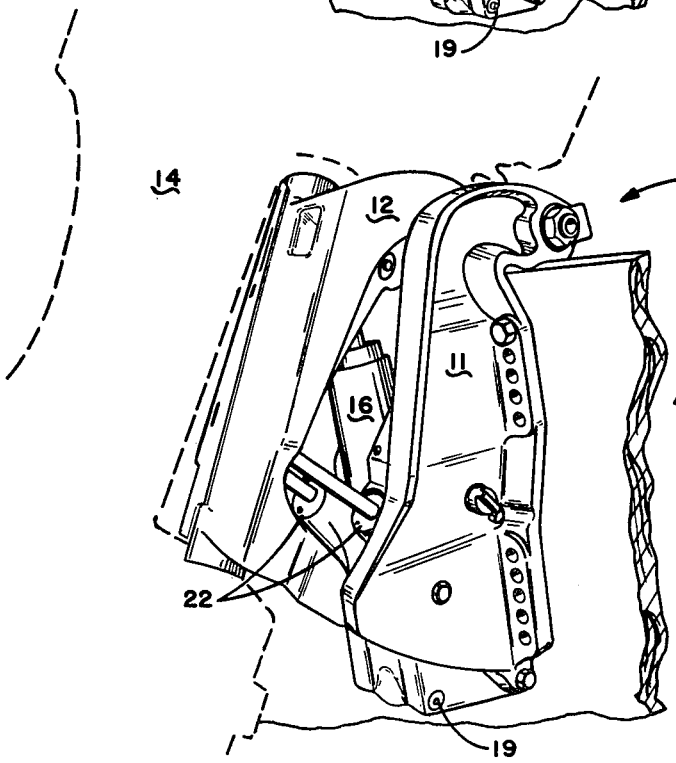
FIG. 2 is a view of the outboard motor of FIG. 1 in the maximum trim position.

A hydraulic trim-tilt system 15 is provided for trimming and tilting the outboard drive unit 14 and for absorbing shock in the event of collision with an underwater obstacle. The hydraulic system 15 includes a trim-tilt hydraulic piston-cylinder unit 16 having its cylinder 17 pivotally connected at its lower end 18 to the transom bracket 11 by a pin 19 and having its piston rod 20 pivotally connected to the swivel bracket by another pin 21. Two hydraulic trim piston-cylinder units 22 are mounted on the transom bracket 11, one on each side of the trim-tilt unit 16, with their piston rods 23 extending to the rear and upward. An electrically operated reversible hydraulic pump unit 24 is mounted in the transom bracket 11 above one of the trim cylinders 22 and includes a spool valve 25 which is connected to drive the hydraulic cylinders 16 and 22. In the full tilt position shown in FIG. 1 the outboard drive unit 14 is supported solely by the fully extended trim-tilt piston-cylinder unit 16, while in the maximum trim position shown in FIG. 2 and lower trim positions the drive unit 14 is supported by all three hydraulic piston-cylinder units.

Figure 3:
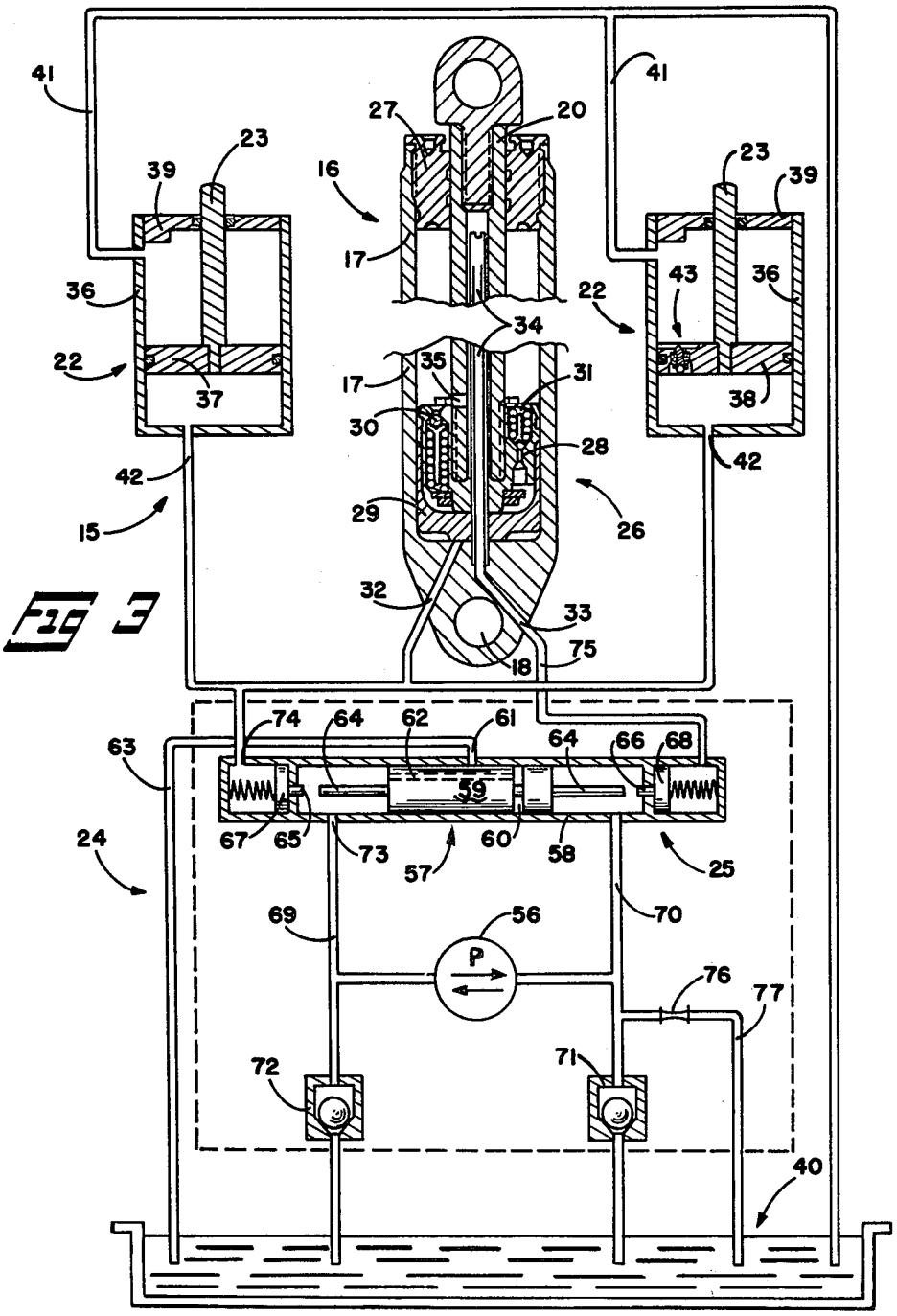
FIG. 3 is a schematic view of the hydraulic system incorporated in the outboard motor of FIGS. 1 and 2.

The trim-tilt piston-cylinder unit 16 shown in FIG. 3 is similar to those shown in FIGS. 9, 10, and 11 of U.S. Pat. No. 4,052,952. The unit 16 includes a cylinder 17 which receives a piston assembly 26, a cylinder end cap 27, and a piston rod 20 attached to the piston 26 and extending through the cylinder end cap 27. The piston assembly 26 includes a shock piston 28 attached to the piston rod 20 and a floating trim piston 29. The shock piston 28 includes a spring loaded ball shock valve 30 to allow flow through the shock piston 28 in response to the shock loading on the piston rod 20 should the lower drive unit strike an object underwater. Thus under a shock load the drive unit 14 will tilt up, extending the piston rod 20, and pulling the shock piston 28 away from the trim piston 29. A spring loaded ball return valve 31 in the shock piston 28 allows the outboard drive unit 14 to gently return to its lower position when the shock load has passed. A first inlet 32 is provided to supply hydraulic fluid to the bottom side of the piston assembly and a second inlet 33 is provided to supply hydraulic fluid to the top side of the piston assembly. The second inlet is connected to the top side of the piston assembly by a tube 34 telescoped into the tubular piston rod 20 and a hole 35 in the side of the piston rod 20 near the top of the shock piston 28.

The trim piston-cylinder assemblies 22 include closed cylinders 36 mounted in the transom bracket 11, pistons 37 and 38 mounted in the cylinders 36, and piston rods 23 extending through the cylinder caps 39. The cylinders 22 are connected above the pistons 37 to the sump 40 by passageways 41. Below the pistons 37 and 38 the cylinders 36 are connected by passageways 42 to the pump unit 24. One of the pistons 38 includes a pilot operated check valve 43 which acts to limit the maximum pressure below the pistons 26, 37 and 38 in both the trim and trim-tilt units 16 and 22 when the trim pistons have reached the top of their stroke. The pilot operated check valve 43 is most clearly illustrated in FIGS. 4, 5, and 6 and includes a bore 44 through the piston 38. A restriction at the top of the bore 44 provides a valve seat 46 for the pilot valve member 47 which has a stem 48 projecting through the restriction 45 and a valve seal 49 surrounding the stem 48. A valve seat member 50 for the ball check valve 51 is threadedly engaged in the lower end of the bore 44 and a single coil spring 52 biases both the ball valve member 51 and the pilot valve member 47 toward their closed positions. A spring guide member 53 is provided between the ball valve member 51 and the spring 52 to position the spring 52. A groove 54 in the top of the trim piston 38 provides fluid communication between the valve bore 44 and the upper cylinder port 55 when the trim piston 38 is at the top of its stroke.

Figure 4:
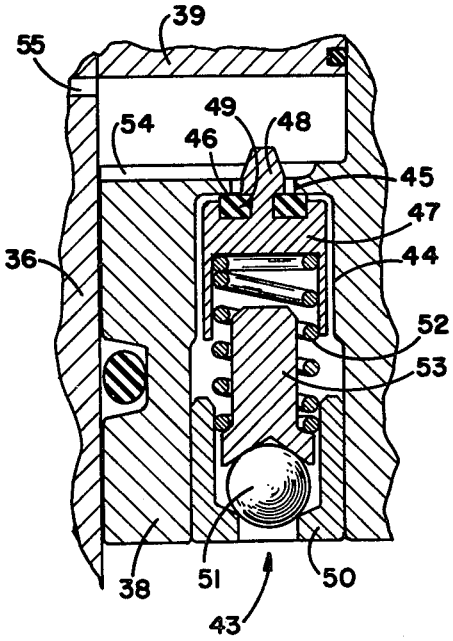
FIGS. 4, 5, and 6 are views illustrating different positions of the pilot operated check valve incorporated in the outboard motor of FIGS. 1 and 2.
Figure 5:
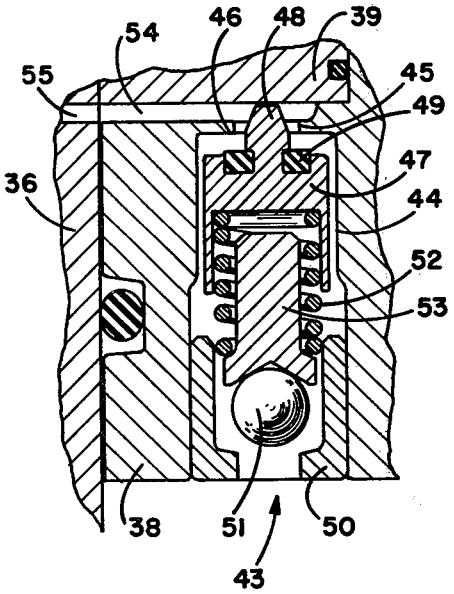
Figure 6:
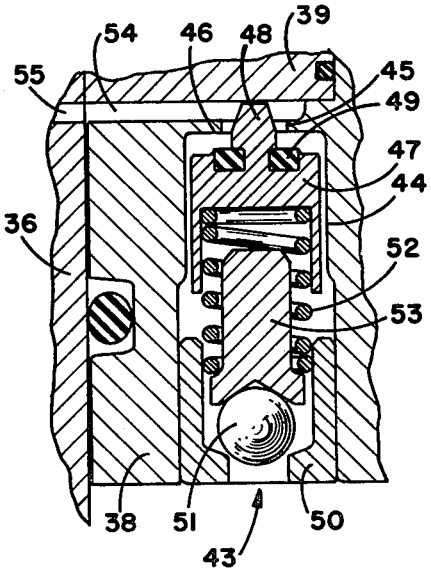

As shown in FIG. 4, the trim piston 38 is below its maximum trim position and hence both the ball 51 and pilot valve members 47 are in their closed positions. In FIG. 5 the trim piston 38 has reached the end of its stroke with the pilot valve stem 48 engaging the cylinder cap 39 to open the pilot valve 47. The pressure below the piston 38 is high enough to open the ball check valve 51 whereby the flow through the valve serves to regulate the pressure in the hydraulic system below the piston 38. In FIG. 6, the trim piston 38 is in the same position as in FIG. 5, but the hydraulic pressure below the piston 38 is at or below the desired pressure level and the ball check valve 51 is closed.

The hydraulic pump unit 24, indicated within the dashed line in FIG. 3 includes a reversible electric motor driven gear pump 56 and a shuttle valve 25. The complete hydraulic pump unit 24 is commercially available from The Prestolite Company as Model No. EO-28334-4. A reservoir or sump 40 is used to provide an adequate supply of hydraulic fluid to the system. The spool valve 25 in the pump unit 24 operates in response to pressurized fluid to control the fluid flow from the pump 56 to the piston-cylinder units and back.

The spool valve 25 includes a spool 57 which is axially movable in a closed tubular valve housing 58. The spool 57 includes a central piston 59 having a recessed portion 60 which provides communication because a center port 61 and the left side of the spool 57 via a passageway 62 through the spool 57. The center port 61 is connected by a passageway 63 to the sump 39. The spool 57 further includes oppositely extending plunger portions 64 attached to the central piston 59 which serve to open the flow control ports 65 and 66 when the spool 57 is shifted to the left or right. Flow through the flow control ports 65 and 66 and the connecting passageways is further controlled by spring biased valve members 67 and 68 which are opened by the plunger portions 64 of the spool 57. The spool valve 25 is connected to the opposite sides of the pump 56 by two passageways 69 and 70. The passageways 69 and 70 connect to the sump 40 through the ball check valves 71 and 72 which serve to selectively permit or prevent flow from the sump 40.

OPERATION

In operation, with the trim and trim-tilt pistons 37, 38 and 26 in their lower positions the outboard propulsion unit 14 may be trimmed out, i.e., up, by turning on the electric motor driven pump 56 to supply pressure to the port 73 in the spool valve 25. The pressure of the fluid will then open the spring biased valve member 67 to allow flow through the flow control port 65 and out the port 74 to supply hydraulic fluid to the trim-tilt and trim cylinders by means of the fluid pasage 42, thereby raising the pistons. Simultaneously the pressure will drive the spool valve member 57 to the right and the plunger 64 will open the flow control port 66 to allow the hydraulic fluid above the trim-tilt piston 26 to return to the suction side of the pump. The hydraulic fluid above the trim pistons 37 and 38 will return to the sump 40 by way of the fluid passageways 41 and the additional fluid required by the pump 56 will be made up by upward flow from the sump 40 through the ball check valve 71.

When the trim pistons 37 and 38 have reached the top of their stroke the pilot operated check valve 43 will open, thereby limiting the maximum pressure of the fluid supplied to the trim-tilt piston-cylinder unit 16. With a properly sized spring 52 in the pilot operated check valve 43 the pressure in the system will be reduced sufficiently to prevent the trim-tilt piston 26 from overcoming the thrust of the outboard propulsion unit, thereby preventing tilting of the outboard propulsion unit 14 when the propeller is producing foward thrust.

To tilt the drive unit down, the electric motor driven pump 56 is reversed to supply fluid to the right side of the spool valve member 57, thereby opening the right flow control port 66 and supplying fluid by the passage 75 to the top of the trim-tilt cylinder 16 and driving the trim-tilt piston 26 downward. The pressure on the right will drive the spool valve member 57 to the left, thereby opening the left flow control port 65 to the pump inlet. At the same time the recessed portion 60 of the spool valve piston 59 will align with the center port 61 in the valve housing 58 to open a return passage from the left side of the spool valve piston 57 through the passage 62 in the spool 57 to the sump 40. Thus when the trim-tilt piston 26 begins to drive the trim pistons 37 and 38 downward, the excess fluid will return to the sump. The small orifice 76 in the fluid passage 77 relieves the pressure on the right side of the spool valve member 57 when the pump 56 is turned off to allow the spool valve member 57 to rapidly return to the center position.

I claim:

1. A hydraulic system for trimming and tilting an outboard propulsion unit pivotally mounted on a support member for mounting on a boat, said hydraulic system comprising:

(A) a first extensible hydraulic piston-cylinder unit pivotally connected to said propulsion unit and to said support member;

(B) a second extensible hydraulic piston-cylinder unit connected to one of said propulsion unit and said support member and having an extensible part engaging the other of said propulsion unit and said support member, said second piston-cylinder unit including a cylinder having closed ends, a piston reciprocably mounted in said cylinder, and a piston rod connected to said piston and extending through one of said closed ends;

(C) a hydraulic pump;

(D) a conduit means hydraulically connecting said first and second hydraulic piston-cylinder units to said hydraulic pump to supply said first and second hydraulic piston-cylinder unit with hydraulic fluid; and (E) a pressure relief means to limit the maximum pressure of the hydraulic fluid supplied to said first piston-cylinder unit only when said second piston-cylinder unit has extended a predetermined amount, said pressure relief means including a relief valve through said piston and a pilot operated check valve to prevent flow through said relief valve except when said second piston-cylinder unit has extended said predetermined amount.

2. The hydraulic system defined in claim 1 wherein said first hydraulic piston-cylinder unit comprises a closed cylinder and a piston assembly reciprocably mounted in said cylinder, said piston assembly including a piston rod extending through one end of said cylinder, a first piston attached to said piston rod, and a trim piston reciprocably mounted in said cylinder, said first piston having a shock valve allowing flow through said first piston to allow said first piston to separate from said trim piston in response to shock loading on said piston rod and a return valve allowing flow through said first piston to permit said first piston to return to said trim piston when said shock loading has passed.

3. A hydraulic system for trimming and tilting an outboard propulsion unit pivotally mounted on a support member for mounting on a boat, said hydraulic system comprising:

(A) a first extensible hydraulic piston-cylinder unit pivotally connected to said propulsion unit and to said support member;

(B) a second extensible hydraulic piston-cylinder unit connected to one of said propulsion unit and said support member and having an extensible part engaging the other of said propulsion unit and said support member, said second piston-cylinder unit including a cylinder having closed ends, a piston mounted for reciprocation in said cylinder, and a piston rod connected to said piston and extending through one of said closed ends;

(C) a hydraulic pump;

(D) a conduit means hydraulically connecting said first and second hydraulic piston-cylinder units to said hydraulic pump to supply said first and second hydraulic piston-cylinder unit with hydraulic fluid; and (E) a pressure relief means to limit the maximum pressure of the hydraulic fluid supplied to said first piston-cylinder unit only when said second piston-cylinder unit has extended a predetermined amount, said pressure relief means including:

(1) a bore through said piston, and (2) a pilot operated valve mounted in one end of said bore, said pilot valve including a valve stem projecting from one end of said bore to engage one of said closed ends when said second piston-cylinder unit has extended said predetermined amount to open said pilot valve.

4. The hydraulic system defined in claim 3 wherein said pressure relief means further comprises a pressure relief valve mounted in said bore.

5. The hydraulic system defined in claim 4 wherein said pressure relief means comprises a valve seat at each end of said bore.

6. The hydraulic system defined in claim 5 wherein said pilot valve comprises a pilot valve member attached to said valve stem and said relief valve comprises a ball valve member.

7. The hydraulic system defined in claim 6 wherein said pressure relief means further comprises a coil spring mounted between said valve members to bias said valve members to close said valve seats.

* * * * *